United States Patent [19]

Occelli

[11] Patent Number: 4,577,973

[45] Date of Patent: Mar. 25, 1986

[54] METHOD AND DEVICE FOR MIXING UNDER VACUUM MIXTURES USED IN DENTAL, GOLDSMITH FIELDS OR THE LIKE

[76] Inventor: Luciano Occelli, Via Solari 52, Milan, Italy, 20144

[21] Appl. No.: 580,556

[22] Filed: Feb. 14, 1984

[30] Foreign Application Priority Data

Feb. 24, 1983 [IT] Italy ..... 19725 A/83

[51] Int. Cl.[4] ..... B01F 13/06

[52] U.S. Cl. ..... 366/139; 141/8

[58] Field of Search ..... 141/1, 8, 85, 98; 222/152; 366/101, 102, 103, 104, 106, 139, 154, 155, 156, 157, 163, 189, 191, 279, 349, 602

[56] References Cited

U.S. PATENT DOCUMENTS

| | | | |
|---|---|---|---|
| 1,422,102 | 7/1922 | Hutchinson | 366/139 |
| 3,664,096 | 5/1972 | LeJuene | 366/139 |
| 3,782,695 | 1/1974 | Sandiford | 366/139 |
| 3,969,314 | 7/1976 | Grigull | 366/139 |
| 4,185,072 | 1/1980 | Puderbaugh | 366/139 |
| 4,402,351 | 9/1983 | Momura | 141/98 |
| 4,430,084 | 2/1984 | Deaton | 141/8 |
| 4,486,100 | 12/1984 | Endo | 366/139 |

FOREIGN PATENT DOCUMENTS

| | | | |
|---|---|---|---|
| 247272 | 1/1961 | Australia | 366/139 |
| 8203832 | 11/1982 | PCT Int'l Appl. | 141/1 |

*Primary Examiner*—Robert W. Jenkins

*Attorney, Agent, or Firm*—Wenderoth, Lind & Ponack

[57] ABSTRACT

A mixture of a powder and a liquid is formed and poured, under vacuum into suitable containers for the subsequent production of molds to be employed in dental and goldsmith fields. In order to achieve the best degassing conditions and to avoid the production of foams and bubbles in the course of the vacuum mixing step, separate degassing of the liquid and powder components of the mixture is performed in separate vessels before the mixing step, followed by a combination, for example by pouring, of the components in one of the vessels, while maintaining the vacuum conditions.

14 Claims, 4 Drawing Figures

METHOD AND DEVICE FOR MIXING UNDER VACUUM MIXTURES USED IN DENTAL, GOLDSMITH FIELDS OR THE LIKE

BACKGROUND OF THE INVENTION

1. Field of the Invention

This invention relates to a method and device for mixing under vacuum a mixture which can be obtained from a powder and a liquid and which is intended to be subsequently admitted into containers in order to produce molds to be used in dental and goldsmith fields or the like.

2. Description of the Prior Art

It is well known, in the above mentioned fields, to prepare under vacuum a mixture of the above type, by means of a so called "spatulation" or mixing operation made by hand or mechanical means within a vessel placed under vacuum and into which the liquid and powder of the mixture or "coating mass" have been previously admitted. Usually, this mixing step is continued until a coating mass homogenization is reached, which, if necessary, is promoted by vibratory means, whereupon this coating mass is admitted, usually poured, into one or more containers, so called "cylinders" located on a rotary plate below the mixing vessel and within a bell also maintained under vacuum, everything in accordance with the well known technique of mold production with very high precision, as in the dental and goldsmith fields.

Mixing and pouring under vacuum are recommanded, if not required, by the need of removing from the coating mass any gas inclusions which could negatively affect the working precision, particularly any $Co_2$ or $O_2$ inclusions which could exert an undesired chemical effect on the coating mass components during the well known subsequent working operations.

It has been found, however, that the technique used till now does not ensure the removal of the above-mentioned gas inclusions and, on the contrary, that during mixing under vacuum there is a tendency to obtain a porous mixture (referred to in this field as "beer effect") produced by expansion caused by the vacuum of the air included within the powder and carbon dioxide dissolved in the water. These gas inclusions in the mass transferred to the cylinders will be more and more difficult to remove, taking into account that the mass consistency continues to increase under the effect of the beginning setting.

SUMMARY OF THE INVENTION

It is the object of this invention to provide a new method and device for carrying out vacuum mixing under the above mentioned conditions, which surely prevent such porosity production and therefore the gas inclusions in the coating mass by reducing the $O_2$ and $CO_2$ contents in the coating mass to any desired level.

To attain this and other objects which will become apparent in the course of the following description, there is provided according to the invention a method of the above mentioned type in which, before the mixing step, the liquid and powder components of the mixture are subjected to a degassing step in separate vessels put under vacuum, and then combined and mixed again, while maintaining the vacuum conditions.

The previous removal of the gas inclusions from the liquid and powder components according to the invention permits a higher reliability and degree of degassing of the final mixture to be obtained, since the single components will have a much lower consistency than that of the coating mass and therefore permit an easier gas bubble removal. According to this invention it is possible to carry out the degassing step to different levels for the two components and, if necessary, to carry out the degassing step in additional subsequent steps, with intermediate admission of an inert gas to further reduce the final $O_2$ and $CO_2$ contents in the mixture.

To carry out the above mentioned method the invention provides an apparatus comprising a lower bell housing one or more containers intended to receive the mixture, an upper bell forming a mixing vessel capable of being controllably opened to the lower bell and a vacuum source which can be connected to the lower bell and/or the upper bell. The apparatus further includes at least a second vessel intended to temporarily receive the liquid or powder component of the mixture, means for pneumatic controlled connection of the vacuum source to the second vessel and means for fluid connection of the second vessel to the mixing vessel, while substantially maintaining the respective vacuum conditions.

DESCRIPTION OF THE PREFERRED EMBODIMENTS

Figure 1:
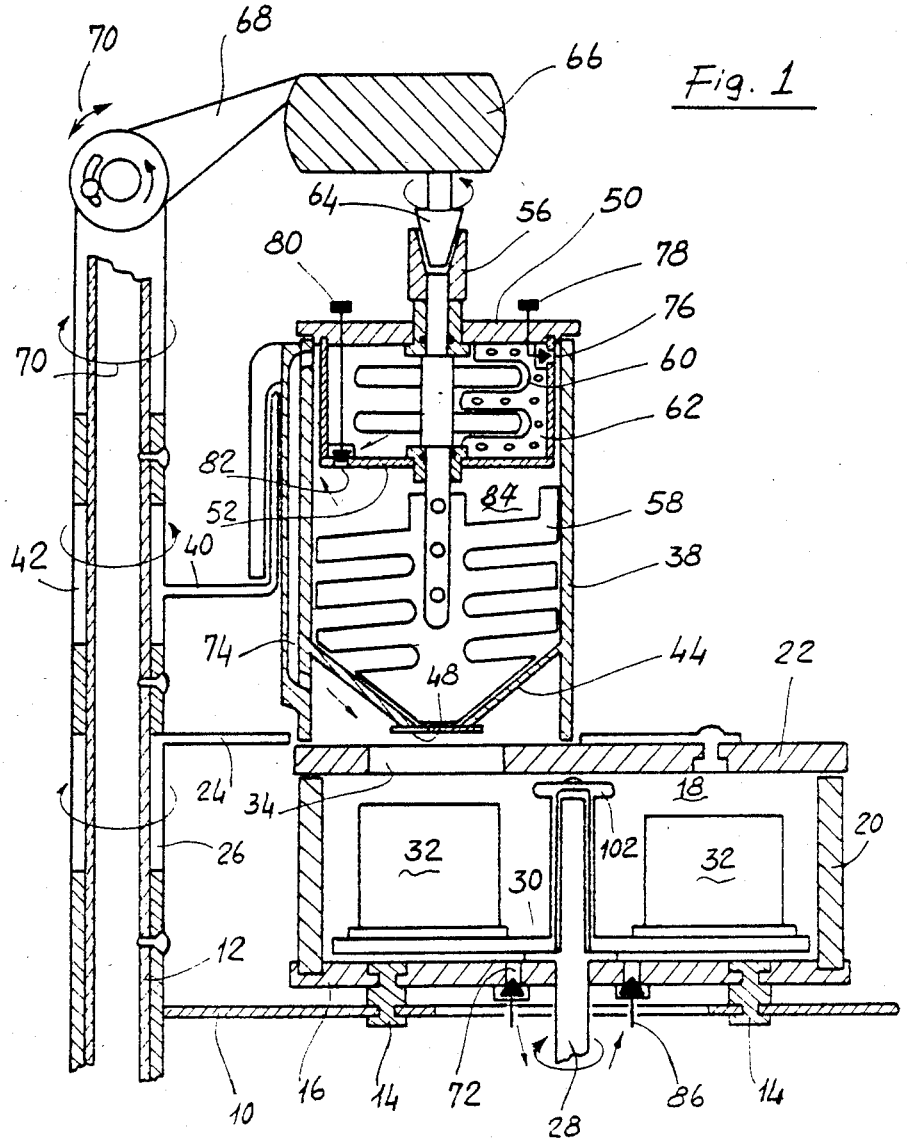
FIG. 1 is a side sectional view of a vacuum mixing apparatus adapted to operate in accordance with the principles of this invention.

Referring first to FIG. 1, the apparatus shown therein includes a stationary base 10 to which a tubular upright 12 is connected and intended to support and controllably move various components, as will be discussed below. Connected to the stationery base 10, for example by elastic anchoring means 14, is a stationary support plate 16 forming the base of a lower bell 18 defined by a side wall 20 and a movable cover 22, which is secured by means of an arm 24 to a rotatable bushing 26 mounted on the upright 12 (see also FIG. 2). Into the lower bell 18 projects a rotatable sealed pivot pin 28, which supports a rotatable plate 30 which is removable from the bell when cover 22 has been removed. On this plate 30 are located containers or cylinders 32, which are intended to contain a mixture or coating mass mixed above the bell 18.

The cover 22 has a through opening 34 around which a seat 36 (FIG. 2) is arranged and intended to receive in an operative position an upper bell 38, substantially formed of a vessel removably supported by an arm 40, in turn supported by a rotatable bushing 42 on the upright 12. The upper bell 38 is provided inside at the lower portion thereof with a frustoconical wall 44 having a lower opening 48 which is controlled by a valving means 88 (FIG. 3) and aligned with the opening 34 of cover 22 in order to be capable of carrying out the pouring of a mixture into the cylinder 32 lying below the opening 34.

Figure 2:
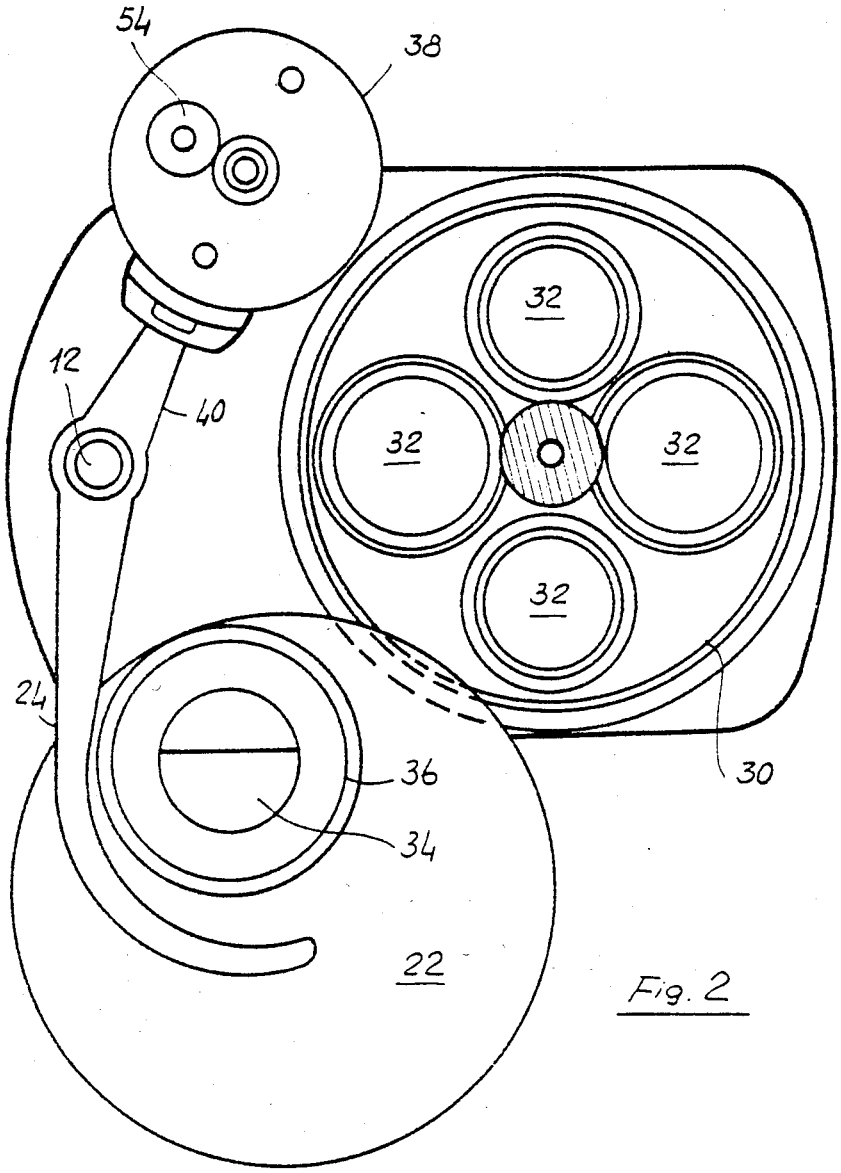
FIG. 2 is a top plan view of the apparatus with its main components thereof shown mutually moved away from each other.

The upper bell 38 is closed by a covering element 50 sealed thereto and carries a second vessel 52 also in sealed relationship thereto, which vessel 52 is insertable into the bell 38 and accessible from the outside through a cover 54 (FIG. 2). A shaft 56 extends through the vessel 52 and is connected to mixing blades 58 made the stainless steel and known per se. The shaft 56, passing through the walls of the vessel 52 in sealed relationship thereto, carries also blades 60 operating within vessel 52, if necessary in cooperation with fixed baffles 62, which avoid the generation of a whirling motion. shaft 56 is controllable by a coupling 64 driven by a geared motor 66 mounted on an arm 68 which rotates, as indicated by the arrows 70, at the upper end of the upright 12.

The different components, namely lower bell 18, upper bell 38, vessel 52 and covers 22, 50 and 54, can be arranged so as to provide in the operative condition of FIG. 1, relative pneumatic sealing sufficient to permit the evacuation of the inner spaces of such elements.

To achieve this the stationary plate 16 has a connection 72 to a suitable vacuum source, through which the lower bell 18 and the portion of the upper bell 38 below the frustoconical wall 44 are evacuated. A conduit 74 provided in the upper bell 38 pneumatically connects the lower portion to the upper portion thereof so as to communicate the vacuum to the mixing vessel where the blades 58 are operating, in such a manner as to evacuate the vessel from the upper portion thereof. Also the vessel 52 can be connected to the vacuum source through an opening 76 provided in the upper portion of the side wall thereof and, if necessary, under control of a valve 78. A second valve 80 controls an opening 82 provided in the bottom of vessel 52 for controllably pouring a substance contained in vessel 52 into a mixing vessel or chamber 84 of the upper bell 38.

The illustrated apparatus is operated as follows. Once cylinder preparation has been carried out and cylinders 32 have been placed on the movable plate 30, the latter is mounted on the pivot pin 28 and the lower bell 18 is closed by moving the movable cover 22 to the closed operative position thereof. The upper bell 38, still open, is placed above the cover 22, with the vessel 84 having therein powder forming a desired mixture. The vessel 84 is closed by the cover 50 carrying the shaft 56 with blades 58 and 60, as well as the upper vessel 52, the valve 80 of which closes the opening 82. Into the vessel 52 is admitted the necessary amount of liquid (generally water) for making the mixture, whereupon the cover 54 is closed. Then, the lower bell 18, the upper bell 38, the vessel 84 and the vessel 52 from their upper portions respectively are evacuated through the opened valve 78. The movable plate 30 is kept on the rotatable pin 28 and fastened thereto by the pressure exerted by the cover 22 of the lower bell 18 which deflects under vacuum, bearing on a knob 102. This acts also as a stop to avoid misalignment of the offset upper bell 38 upon evacuation. During this operation the shaft 56 preferably is operated in order to stir the liquid and powder and to facilitate degassing, which can be further promoted by causing the apparatus to vibrate in a manner known per se. If desired, it is possible to increase the vacuum in the vessel 84 with respect to the vessel 52 by closing the valve 78 and controlling the vacuum source so as to attain a higher vacuum level. The vacuum in the vessel 52 can be increased only to a level permitted by the liquid contained therein, the altitude and the room temperature. If desired, it is further possible for the final $O_2$ and $CO_2$ contents in the mixture to be reduced by carrying out the evacuation in further subsequent steps with admission between subsequent evacuation steps of a inert gas, for example through a connector 86 in the plate 16. This permits the known negative effect of $O_2$ and $CO_2$ during the subsequent operations to be reduced.

Figure 4:
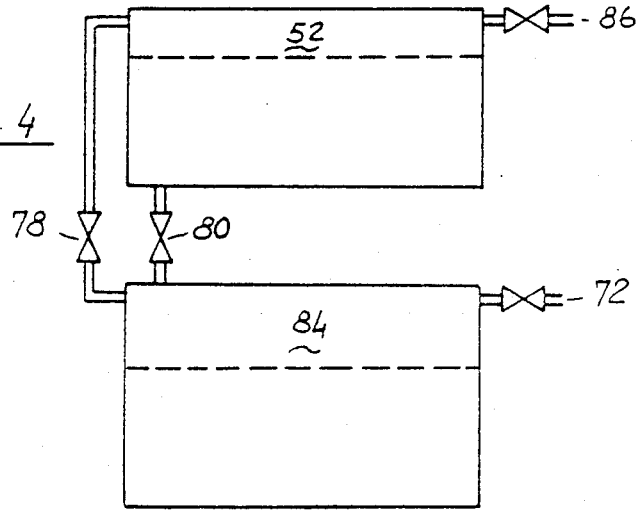
FIG. 4 is a diagrammatic view showing connections for controlling the degassing level and the residual oxygen during separate degassing steps of the mixture components.

In FIG. 4 the arrangement of the two vessels 52 and 84 and the valves 72, 78, 80 and 86 is diagrammatically shown. Referring to this diagram, a degassing operation in more that one step with the admission of an inert gas can be carried out in the following manner. Firstly, the valves 86 and 80 are closed, whereas the valves 72 and 78 are opened. In both the vessels 52 and 84 a vacuum level on the order of 95%, for example, is attained. Then the valves 80 and 72 are closed and the valves 86 and 78 are opened so that the inert gas can flow in to a desired pressure. In a third step, the valves 80 and 86 are closed and the valves 72 and 78 are opened, so that both the vessels are evacuated to 95% of vacuum, for example, with a residual air contents in the order of $25\times10^{-4}\%$ and a residual oxygen contents in the order of $5\times10^{-4}\%$. At this point it is possible to further increase the vacuum level in the vessel 84 only, by closing the valves 78, 80 and 86, by opening the valve 72 only and by increasing the vacuum level up to 99.9%, for example, so as to obtain in the vessel 84 only a residual air content of about $5\times10^{-5}\%$ and a residual oxygen content of $1\times10^{-5}\%$. This vacuum level in the upper vessel 52 would not be possible because of the presence of the liquid.

Figure 3:
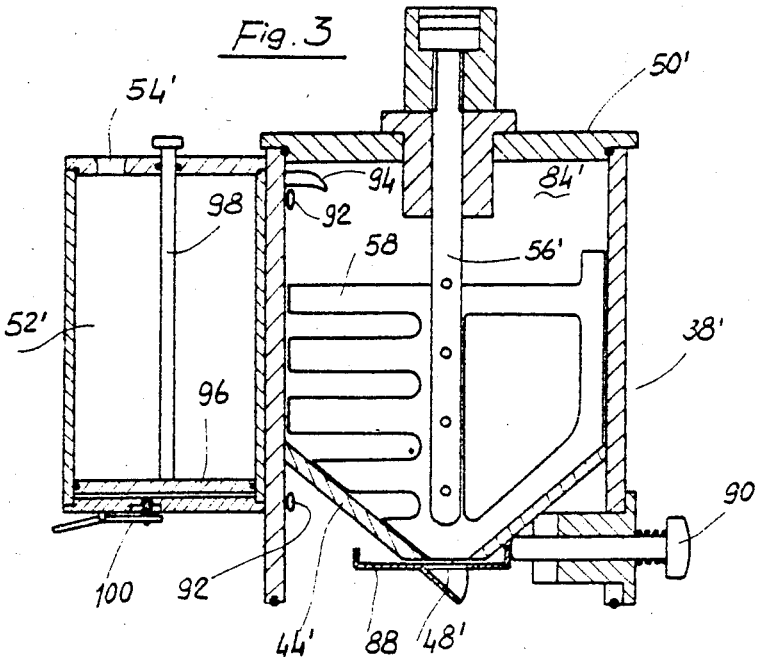
FIG. 3 is a vertical section illustrating another embodiment of a portion of the apparatus according to the invention.

Once the separate degassing of the mixture of the components in the two vessels has been carried out, the components are combined by opening the valve 80, while the valves 78 and 86 are closed and the valve 72 is opened, so that the liquid can be poured through the opening 82 into the vessel 84, where it is mixed with the powder, thereby forming the mixture. When the mixture is formed, this is poured into the cylinders 32 by operating in the conventional manner the shaft 28 of the rotatable plate 30 and the control valve 88 of the delivery opening 48 (FIG. 3). Starting from this time the various operations follow the conventional technique and therefore are not described.

In FIG. 3 there is shown another embodiment of the upper bell 38', forming again a vessel 84' with frustoconical lower walls 44' and a discharge opening 48' controlled by a valve 88, actuated by a push-button 90, for example. A shaft 56' carries blades 58 for mixing the powder and the mixture, the shaft being secured to a cover 50' and connected to an actuating means. Adjacent a wall of bell 38' there is provided a liquid vessel 52' provided with a cover 54' which can be sealed. The pneumatic connection of the vessels 52' and 84' to the vacuum source is made through a first set of openings 92 connecting the vessel 84' with the portion of the bell 38' outside the vessel 84', as well as the upper portions of the vessels 52' and 84'. For pouring the liquid contained in the vessel 52' into the vessel 84', at the end of the degassing step, provided in the vessel 52' a piston 96, having a piston rod 98 which passes through the cover 54' in sealed relationship thereto. A pneumatic valve 100 operated from the outside controls the connection with the atmosphere of the inner portion of the vessel 52', behind the piston 96, so that opening valve 100 causes the piston 96 to be moved upwardly by the resultant pressure differential and therefore the liquid to be poured into the vessel 84'. Of course, various changes and modification can be made to the illustrated embodiment, without departing from the scope of the present invention.

What is claimed is:

1. A method for forming under a vacuum a mixture of a powder and a liquid, intended to be admitted into containers for the subsequent production of molds in the dental or goldsmith fields or the like, said method comprising:

individually degassing the liquid and powder components of the mixture in separate respective liquid and powder vessels under vacuum before mixing said liquid and powder components; and then combining said liquid and powder components and subjecting them to a mixing operation, while maintaining vacuum conditions.

2. A method as claimed in claim 1, comprising producing in said powder degassing vessel a vacuum level different from that produced in said liquid degassing vessel.

3. A method as claimed in claim 2, wherein said vacuum level produced in said powder degassing vessel is higher than that produced in said liquid degassing vessel.

4. A method as claimed in claim 1, comprising conducting said individual degassing in two or more subsequent evacuation operations, between which inert gas is admitted into at least one said vessel.

5. A method as claimed in claim 1, comprising transferring said degassed liquid from said liquid vessel to said powder vessel and conducting said mixing in said powder vessel.

6. An apparatus for forming under vacuum a mixture of a powder and a liquid and intended to be used in dental or goldsmith fields or the like, said apparatus comprising:

a lower bell housing at least one container into which the mixture is to be poured;

an upper bell defining a mixing vessel and controllably operable to be connected to said lower bell;

a vacuum source controllably connectable to said lower bell and/or said upper bell;

a second vessel for temporarily receiving the liquid or the powder;

means for controllably connecting said vacuum source to said second vessel; and means for fluidic connection of said second vessel to said mixing vessel, while substantially maintaining the respective vacuum conditions.

7. An apparatus as claimed in claim 6, wherein said upper bell is connected directly or through said lower bell to said vacuum source, while said second vessel is pneumatically connected to said upper bell through a valve element which can be controlled to have different vacuum conditions with respect to those of said upper bell.

8. An apparatus as claimed in claim 7, further comprising means for controllably connecting an inert gas source to one of said lower and upper bells and/or to said second vessel.

9. An apparatus as claimed in claim 6, wherein said second vessel is located in an upper opening of said mixing vessel and can be hydraulically connected thereto through at least one opening controlled by a valve which can be operated from the outside.

10. An apparatus as claimed in claim 9, further comprising a shaft extending in sealed relationship through said second vessel and carrying first mixing blades operating in said second vessel and second mixing blades operating in said mixing vessel, said shaft being connected to an actuating means for rotating said shaft and said blades.

11. An apparatus as claimed in claim 6, wherein said second vessel is located laterally of said mixing vessel and is hydraulically connected thereto through a conduit, and further comprising a pressure changing means in said second vessel.

12. An apparatus as claimed in claim 11, wherein said pressure changing means in said second vessel comprises a piston movable in sealed relation within said second vessel upon an exterior control.

13. An apparatus as claimed in claim 6, wherein said lower bell is provided with a removable cover on which said upper bell is located, said cover and said upper bell being independently supported so as to rotate about a supporting pin.

14. An apparatus as claimed in claim 13, wherein said removable cover is maintained positioned on said shaft by axial pressure exerted by a cover of said upper bell on a knob mounted on said plate and coaxial to said shaft upon the evacuation of said lower bell.

* * * * *